US006474539B1

(12) United States Patent
Van Der Horst

(10) Patent No.: US 6,474,539 B1
(45) Date of Patent: Nov. 5, 2002

(54) PACKAGING FOR TWO ASSOCIATED ARTICLES

(75) Inventor: Ruben Salvador Van Der Horst, Delft (NL)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/889,426

(22) PCT Filed: Jan. 18, 2000

(86) PCT No.: PCT/NL00/00034

§ 371 (c)(1),
(2), (4) Date: Oct. 17, 2001

(87) PCT Pub. No.: WO00/41939

PCT Pub. Date: Jul. 20, 2000

(30) Foreign Application Priority Data

Jan. 18, 1999 (NL) ..... 1011061

(51) Int. Cl.[7] ..... B65D 5/50

(52) U.S. Cl. ..... 229/120.14; 206/476; 206/564; 206/565; 206/734; 206/756; 229/120.15

(58) Field of Search ..... 229/120.13, 120.14, 229/120.15; 206/45.19, 45.29, 476, 564, 565, 474, 734, 752, 754, 755, 756, 763, 765, 766, 775, 781

(56) References Cited

U.S. PATENT DOCUMENTS 2,458,766 A * 1/1949 Chemlinski ..... 206/763
2,464,951 A * 3/1949 Stengren ..... 206/765
2,803,391 A * 8/1957 Koeble
3,132,744 A * 5/1964 Scharf
3,385,424 A * 5/1968 Thompson et al. ..... 206/756
3,767,037 A * 10/1973 Anderson ..... 206/781
3,865,233 A * 2/1975 Hamlin ..... 206/45.19
4,397,393 A * 8/1983 Pergande et al. ..... 206/775
4,957,202 A * 9/1990 Yoshiki et al.
6,059,180 A * 5/2000 Collins ..... 229/120.13

FOREIGN PATENT DOCUMENTS

DE 295 19 505 U1 * 3/1996
FR 2702193 A1 * 9/1994

* cited by examiner

*Primary Examiner*—Gary E. Elkins
(74) *Attorney, Agent, or Firm*—Young & Thompson

(57) ABSTRACT

A packaging for at least two associated articles comprises a box-like body (1) with a substantially polygonal bottom (10), a number of standing side walls (11, 12) and a cover (20) which closes off the whole in the closed situation. The box-like body herein houses an internal space (30) in which the articles for packaging can be accommodated. According to the invention this internal space (30) is intended to receive therein only a first of the two articles, the first article being supplied as standard. The box-like body (1) is provided with a recess (40) accessible from outside for receiving a second article therein, which second article can be an optional article which is precisely determined only later.

5 Claims, 4 Drawing Sheets

PACKAGING FOR TWO ASSOCIATED ARTICLES

The present invention relates to a packaging for at least two associated articles, comprising a box-like body with a substantially polygonal bottom, a number of standing side walls and a cover which in the closed situation encloses an interior space.

Such packagings are used on a large scale for packing all types of articles. The box-like body herein usually has a rectangular bottom, cover and side walls. The articles for packing are brought together in the internal space and thus packaged together.

Although such a packaging suffices very well for a large number of the applications for which it is suitable, it encounters drawbacks when packaging is involved of two or more associated articles, of which at least one can be freely chosen. An example hereof is for instance a cordless telephone set, wherein the base station and at least some of the accessories are supplied in a standard colour but where the customer is offered a choice in terms of the colour of the associated handset In order to avoid unnecessarily large accusation of stock in such a case, the standard components only are preferably placed beforehand in the space of the packaging and the optional article only added later. A drawback here however is that this is relatively time-consuming and furthermore no direct visual check is then possible as to whether actions have actually taken place. An alternative is separate supply of the second article, although this may be less desirable from a marketing viewpoint.

It is the object of the present invention to provide a packaging of the type stated in the preamble which obviates these drawbacks.

For this purpose a packaging of the type stated in the preamble has the feature according to the invention of the internal space is intended to receive only a first of the two articles and at the box-like body is provided with a recess accessible from outside for receiving a second article therein. All standard components can herein be accommodated from the outset in the internal space of the packaging and thus be supplied as it were as standard package. When later the choice of the second optional article has been determined, his article can be arranged in simple manner in the recess and thus supplied integrally with the rest A direct visual check as to whether the unit is complete or not also remains possible.

In a particular embodiment the packaging according to the invention has the feature that the recess encloses a space for receiving therein in at least practically fitting manner a second box-like body with a form substantially congruent therewith, which second box-like body is intended for receiving the second article. In this case the second article is also prepackaged in a box-like body and, thus packaged, arranged in the recess of the first box-like body. The mutual congruence of the second box-like body and the recess results in an almost completely flat, close-fitting whole resembling a single packaging.

In order to prevent unintentional release of the second packed or loose article from the recess, a preferred embodiment of the packaging according to the invention has the feature that the recess is provided with clamping members to clampingly receive therein the packed or loose second article. Numerous forms of clamping member can herein be envisaged per se, although in a further preferred embodiment the packaging according to the invention is characterized in that the clamping member comprise lips placed along an edge of the recess which extend into the recess and protrude as integral part from the surrounding part of the relevant wall of the boxlike body. Such lips cm be formed together with the periphery of the recess in the same processing step from the material of one of the walls of the box-like body and thereby entail no additional components or processing steps.

In a particular preferred embodiment the packaging according to the invention has the feature that the cover comprises at least one flap depending therefrom intended to fall inside an adjoining side wall of the first box-like body in the closed situation and that the recess opens in the cover and in said flap of the cover. The recess herein extends in the cover as far as an edge thereof where said flap is situated. Such an embodiment is exceptionally simple to manufacture, particularly if at least the second boxlike body has a substantially rectangular bottom. In this respect a filter embodiment of the packaging according to the invention has the feature that the cover comprises two substantially parallel cut portions extending transversely of a boundary line with said flap and running over a first distance in said flap, that first creases are arranged between the outer ends of the cut portions and that at least in the cover between the cut portions there lies a second crease which maintains a second distance relative to the adjacent At crease which is at least practically equal to the first distance. All that is necessary therefore to form the recess in the first box-like body is to arrange said cut portions and creases. As soon as these are arranged the part of the first box-like body enclosed thereby can be folded inward to thus form the recess. The part of the flap involved herein now forms part of the bottom which hereby extends as a continuous whole under the recess. The adjacent side wall of the first box-like body bounds the recess and thus prevents a second box-like body placed in the recess from falling out at all easily.

The invention will now be further elucidated with reference to an embodiment and an associated drawing. In the drawing.

Figure 1:
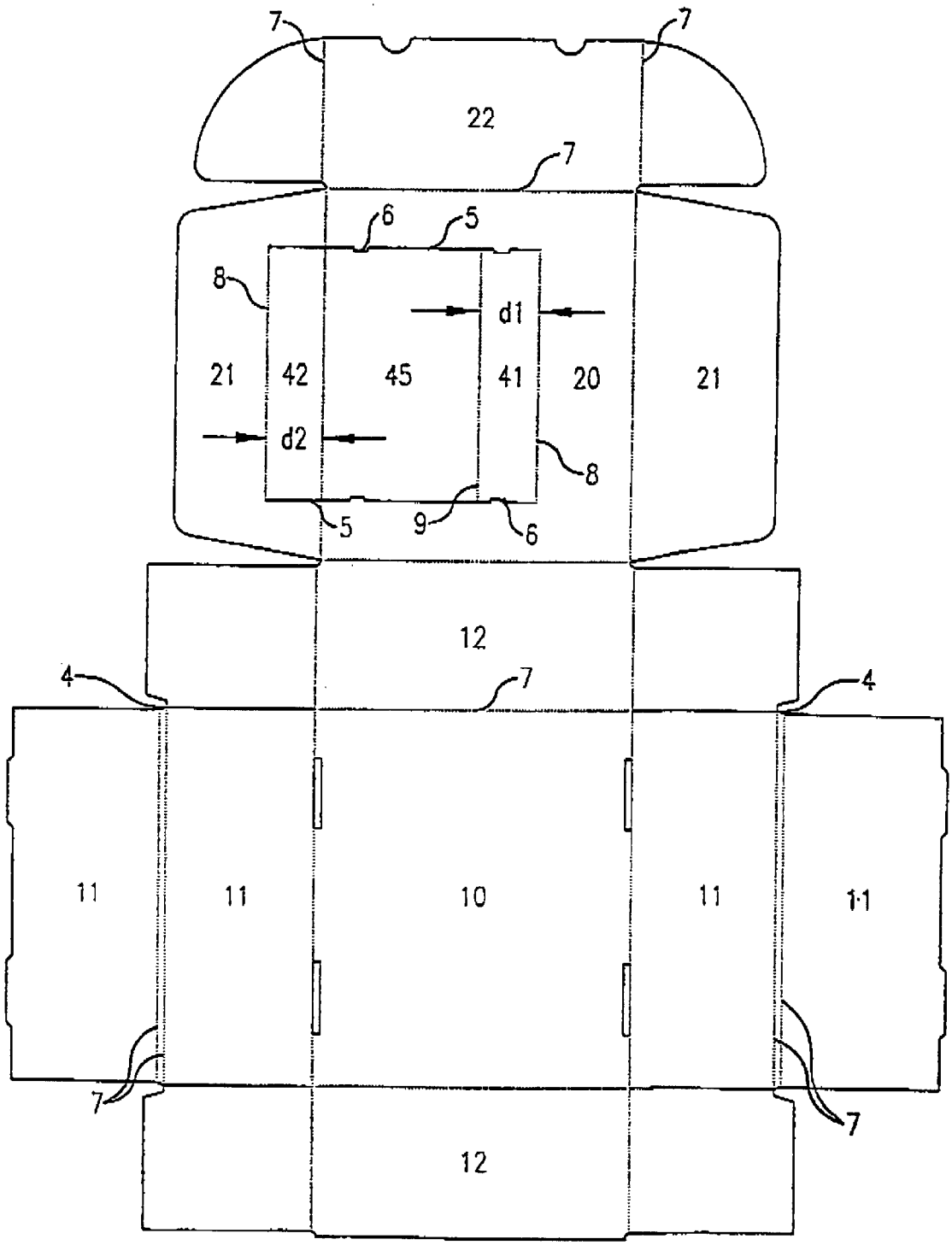
FIG. 1 shows a top view of an embodiment of the packaging according to the invention in unfolded situation.

The figures are otherwise purely scenic and not drawn to scale. Some dimensions in particular may thus be exaggerated for the sake of clarity. Corresponding parts are designated as far as possible in the figures with the same reference numerals. In the shown embodiment the starting point is a box-like packaging which is commercially available per se and therein designated FEFCO 0427. The packaging is manufactured entirely from a suitable cardboard. For this purpose the periphery shown in FIG. 1 is cut, punched or otherwise released from a sheet. of cardboard, wherein cut portions 4, 5, 6 and folding creases 7, 8, 9 are arranged at a number of locations which are indicated in the figure respectively with full lines and dotted lines. All cut portions 4 . . . 6 and creases 7 . . . 9 extend in only two directions, whereby the whole allows of manufactured in just a few processing steps. As a result of the prearranged cut portions 4 . . . 6 and creases 7 . . . 9 it is possible to form a box-like body 1 in simple manner from the flat part, as will become apparent with reference to FIG. 2.

Figure 2:
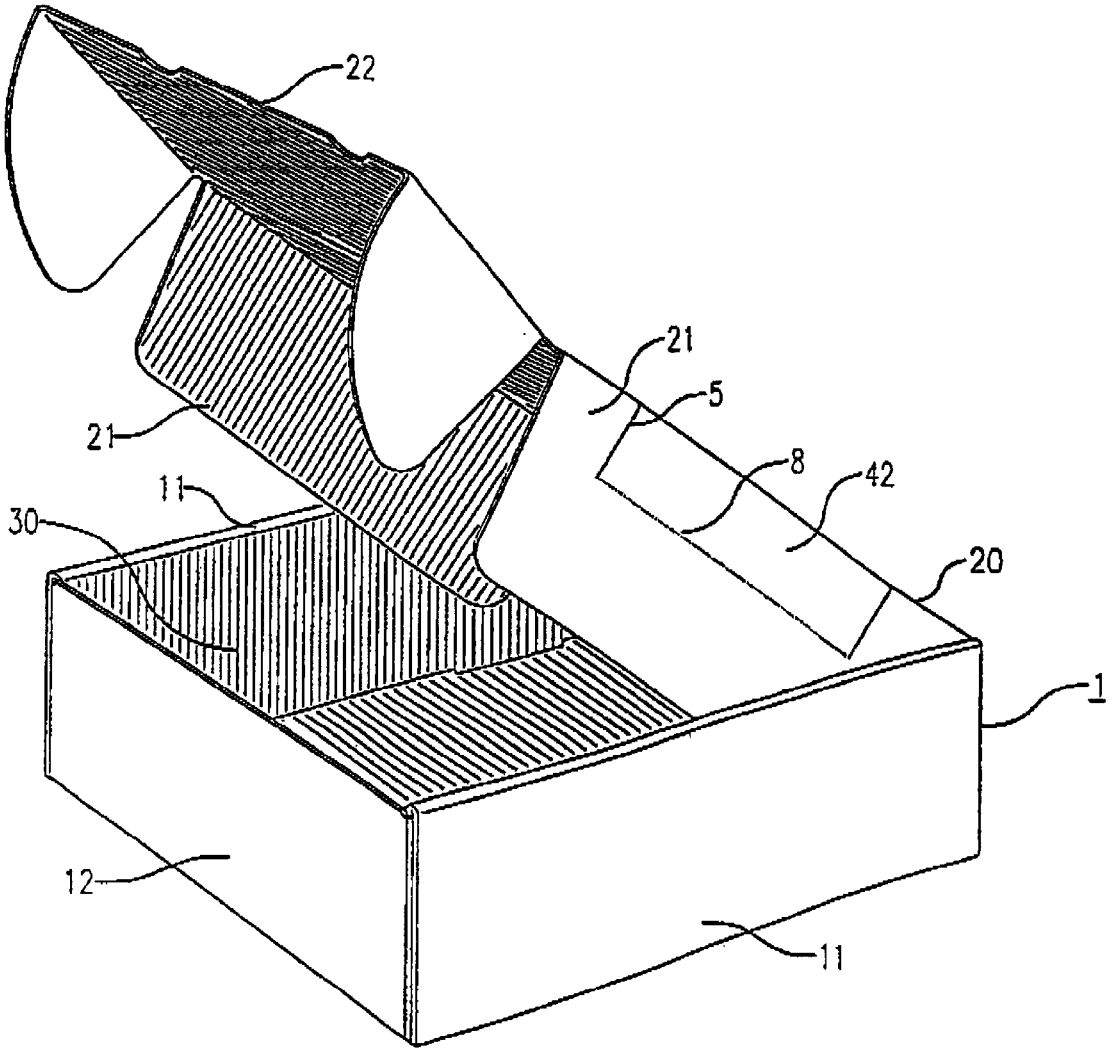
FIG. 2 shows in perspective the packaging of FIG. 1 in folded, but open situation.
Figure 3:
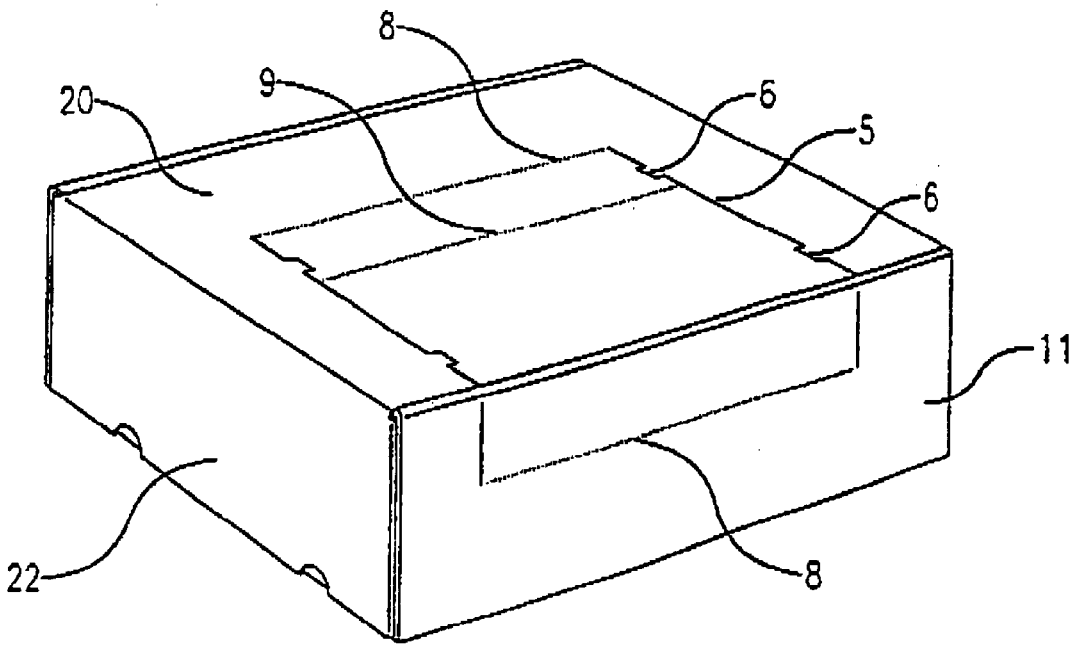
FIG. 3 shows in perspective the packaging of FIG. 1 in folded and closed situation.

The box-like body 1 for forming is provided with a polygonal, more particularly rectangular bottom 10, four standing side walls 11, 12 and a cover 20. Two opposite side walls 11 herein take a dual foil to later give box-like body 1 cohesion and more sturdiness. Cover 20 is provided with three depending flaps 21, 22, two of which 21 fall inside the double side walls 11 and of which the remaining flap 22 functions as closing flap for reliable closure of boxlike body 1. Reference is made to FIG. 2, which shows the packaging in perspective in folded but open situation. In the closed situation shown in FIG. 3 the box-like body 1 encloses an internal space 30 intended for receiving therein the articles for packing.

Figure 4:
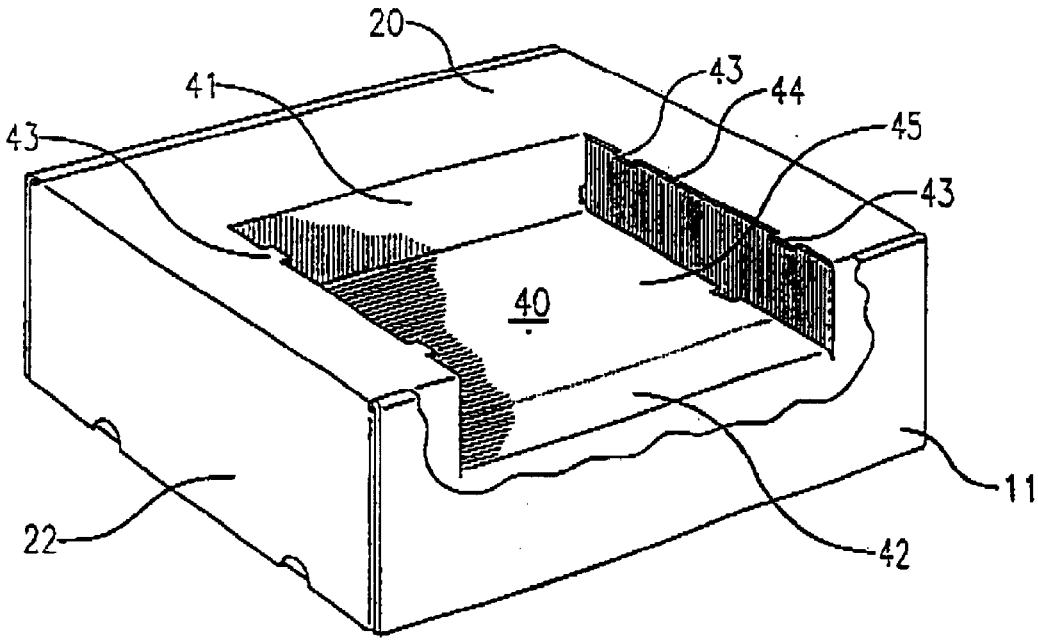
FIG. 4 shows in perspective a partly cut-away view of the packaging of FIG. 1.
Figure 5:
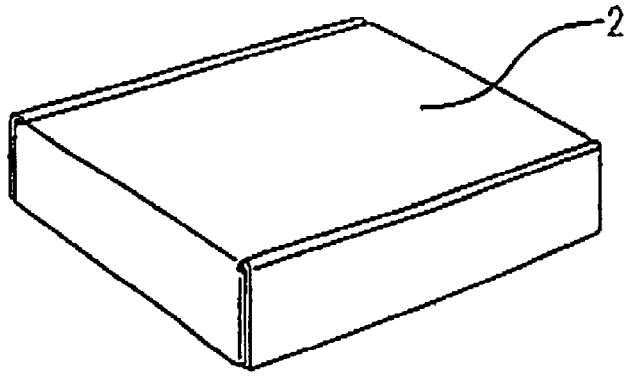
FIG. 5 shows in perspective a second box-like body forming part of the packaging of FIG. 1.

A part of cover 20 and of one of the flaps 21 depending therefrom can easily be pressed inward so as to thus form the recess 40 accessible from outside shown in FIG. 4. Prearranged for this purpose in cover 20 were two practically parallel cut portions 5 extending transversely of the boundary line 13 with said flap 21 and running over a first distance d1, see FIG. 1, in this flap 21. First fold creases 8 were also arranged between the ends of cut portions 5 to facilitate the inward folding, wherein at a second distance d2 from the first fold crease 8 in cover 20 there lies a second fold crease 9 which, conversely, folds outward because the first dince d1 and second distance d2 are equal to each other, the part of cover 20 which ultimately foes a standing wall 41 of recess 40 is exactly compensated by the part of flap 21 which falls inward to form a part 42 of the bottom 45 of recess 40. A fully continuous bottom 45 is thus obtained which forms an excellent base for receiving thereon the second boxlike body 2 shown in perspective in FIG. 5. Recess 40 is otherwise wholly bounded by one of the double side walls 11 of first box-like body 1, although for the sake of clarity a part of said side wall 11 is shown cut-away in FIG. 4.

Figure 6:
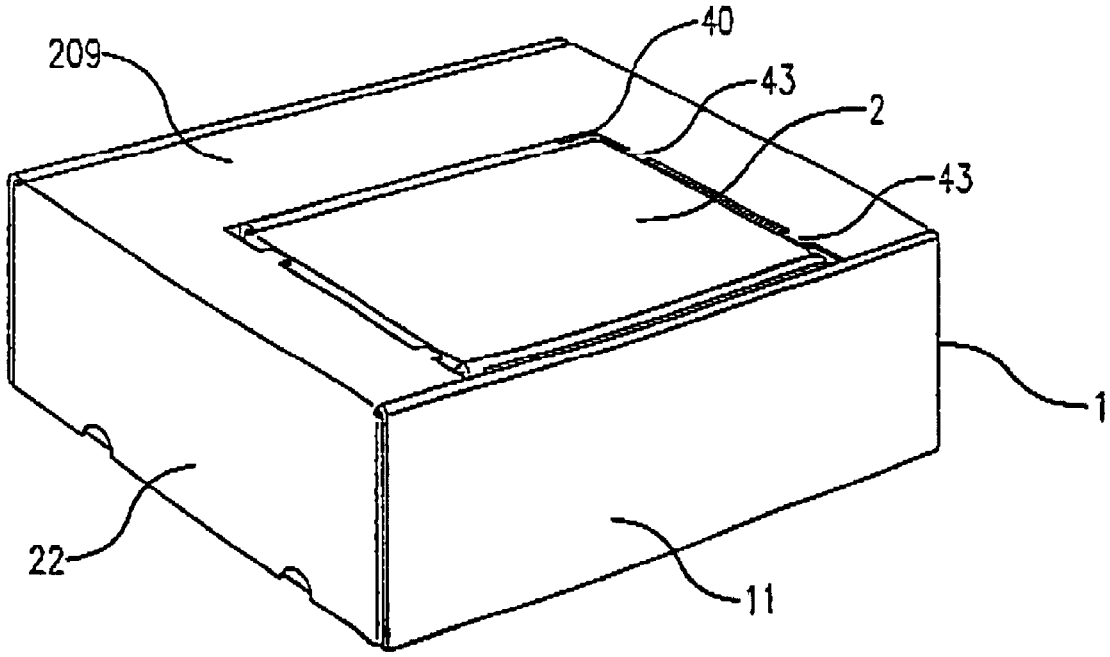
FIG. 6 shows in perspective the packaging of FIG. 1 in assembled situation with the second box-like body of FIG. 5.

The second box-like body 2 is practically congruent with the space enclosed by recess 40 in first box-like body 1, so that it is received close-fittingly therein. Recess 40 is moreover provided with clamping members in the form of a number of lips 43 lying along the edge 44 of recess 40 and extending into recess 40. Owing to these lips 43 the second box-like body 2 lies clampingly in recess 40, as shown in FIG. 6, so that it is less likely to fall out of the recess. Lips 43 otherwise extend as integral part from the surrounding part of cover 20 and thus do not form separate components or an additional processing step. As shown in FIG. 1, lips 43 were formed by cut portions 6 adapted for this purpose in the same processing step in which the other cut portions 4, 5 were arranged.

The assembled packaging of FIG. 6 looks like an integral unit, which can be firer emphasized by a suitable printing of the packaging which continues on the second box-like body or forms a whole therewith. This is particularly attractive from a marketing viewpoint. The packaging nevertheless consists of two separate box-like bodies 1, 2. The firs box-like body 1 is intended to receive one or more first standard articles. The second box-like body 2 on the other hand is intended to receive one or more associated second optional articles. The optional articles can be interchanged freely without problem with for instance other types of or differently colored articles intended for supply with the first articles, The definitive choice can even be postponed to the retail sage. Because the second box-like body 2 can be placed from outside into recess 40, the first box-like body 1 does not have to opened to combine all articles in one packaging. Unintentional loss of articles is thus avoided. It is moreover clear at a glance whether the second articles have been added or not Placing of an effective warning on the bottom 45 of recess 40 indicating that the unit is not yet complete creaks an additional possibility of avoiding the supply of an incomplete set of articles.

A packaging is thus obtained which is particularly flexible and thereby offers additional logistical and marketing possibilities.

Although the invention has been further elucidated in the foregoing with reference to only a single embodiment, it will be apparent that the invention is in no way limited to the given example. On the contrary, many variations and embodiments are still possible for the average skilled person without departing from the scope of the invention. It is thus possible within the scope of the invention to vary without problem the rectangular beam shape in respect of both the first and the second box-like body. Within the scope of the invention the second box-like body can optionally be omitted, in which case a second optional article is placed directly into the recess. In addition, the recess can, if desired, be arranged in one of the other walls of the first box-like body instead of in the cover.

What is claimed is:

1. Packaging for at least two associated articles, comprising a box-like body (1) with a substantially polygonal bottom (10), a number of standing side walls (11, 12) and a cover (20) which in a closed situation encloses an interior space, wherein said internal space (30) is intended to receive therein only a first of the two articles and wherein the box-like body is provided with a recess (40) accessible from outside for receiving a second of the two articles therein, characterized in that the cover comprises at least one flap (21) hanging therefrom intended to be folded down in the closed situation inside an adjacent said side wall (11) of said box-like body and that the recess (40) opens in the cover and in said flap of the cover.

2. Packaging as claimed in claim 1, characterized in that said recess has a substantially rectangular bottom.

3. Packaging as claimed in claim 2, characterized in that the cover comprises two substantially parallel cut portions (5) extending transversely of a boundary line (13) with said flap (21) and running over a first distance (d1) in said flap, first creases (8) being arranged between the outer ends of the cut portions and that at least in the cover between the cut portions there lies a second crease (9) which maintains a second distance (d2) relative to the adjacent first crease which is at least practically equal to the first distance.

4. Packaging as claimed in claim 1, characterized in that the recess is provided with clamping members to clampingly receive therein said second article.

5. Packaging as claimed in claim 4, characterized in that the clamping members comprise lips (43) placed along an edge of the recess which extend into the recess.

* * * * *